US005816983A

United States Patent [19]

Dawes et al.

[11] Patent Number: 5,816,983

[45] Date of Patent: Oct. 6, 1998

[54] AEROBIC BOUNCING, EXERCISING, STRETCHING CHAIR

[76] Inventors: Charles R. Dawes, 4885 Gray St., Denver, Colo. 80212; Robert M. Fenner; Scott A. Fenner, both of Box 334, Englewood, Colo. 80151

[21] Appl. No.: 821,999

[22] Filed: Mar. 22, 1997

[51] Int. Cl.[6] ..... A63B 26/00

[52] U.S. Cl. ..... 482/78; 482/77; 482/130

[58] Field of Search ..... 482/69, 77, 78, 482/121, 129, 130; 297/274

[56] References Cited

U.S. PATENT DOCUMENTS

| | | | |
|---|---|---|---|
| 329,653 | 11/1885 | Kitchen | 482/130 |
| 342,020 | 5/1886 | Kitchen | 482/130 |
| 421,045 | 2/1890 | Caldwell | 482/130 |
| 1,275,757 | 8/1918 | Rosenberg | 482/130 |
| 2,672,916 | 3/1954 | Kenney | 297/274 |
| 4,948,120 | 8/1990 | Krueger et al. | 297/274 |
| 5,499,949 | 3/1996 | Heubl | 297/274 |

*Primary Examiner*—Lynne A. Reichard
*Attorney, Agent, or Firm*—Edwin H. Crabtree; Ramon L. Pizarro; Donald W. Margolis

[57] ABSTRACT

An aerobic bouncing chair and chair frame exercise equipment for performing a variety of aerobic, body strengthing, stretching and lymphatic circulation exercises. The exercise equipment includes a chair frame having a first side frame, a second side frame and a "C" shaped rear frame. The "C" shaped rear frame fits inside and is secured to the top of the first and second side frames for holding the entire chair frame in place. A seat with a back support includes four support straps with four suspension rings attached to the ends of the straps. The four suspension rings are attached to one end of four coil springs. An opposite end of the coil springs is attached to the chair frame. Two of the coil springs are secured to the rear frame and the other two coil springs are secured to the front of the first and second side frame. The four support straps are adjustable for people of different heights and weights. Also the back support may include a safety belt to prevent the user of the chair from slipping off or bouncing off the seat. The seat also includes four seat rings attached to the underside of the seat at its corners. Each of the seat rings is used for receiving the hook ends of bungee cords or other securing types of material. The bungee cords are wrapped around a portion of the front and back of the first and second side frames. The bungee cords steady the seat from moving when a user, for example a wheelchair person, is transferred from the wheelchair onto the seat and prior to the exercise program.

18 Claims, 2 Drawing Sheets

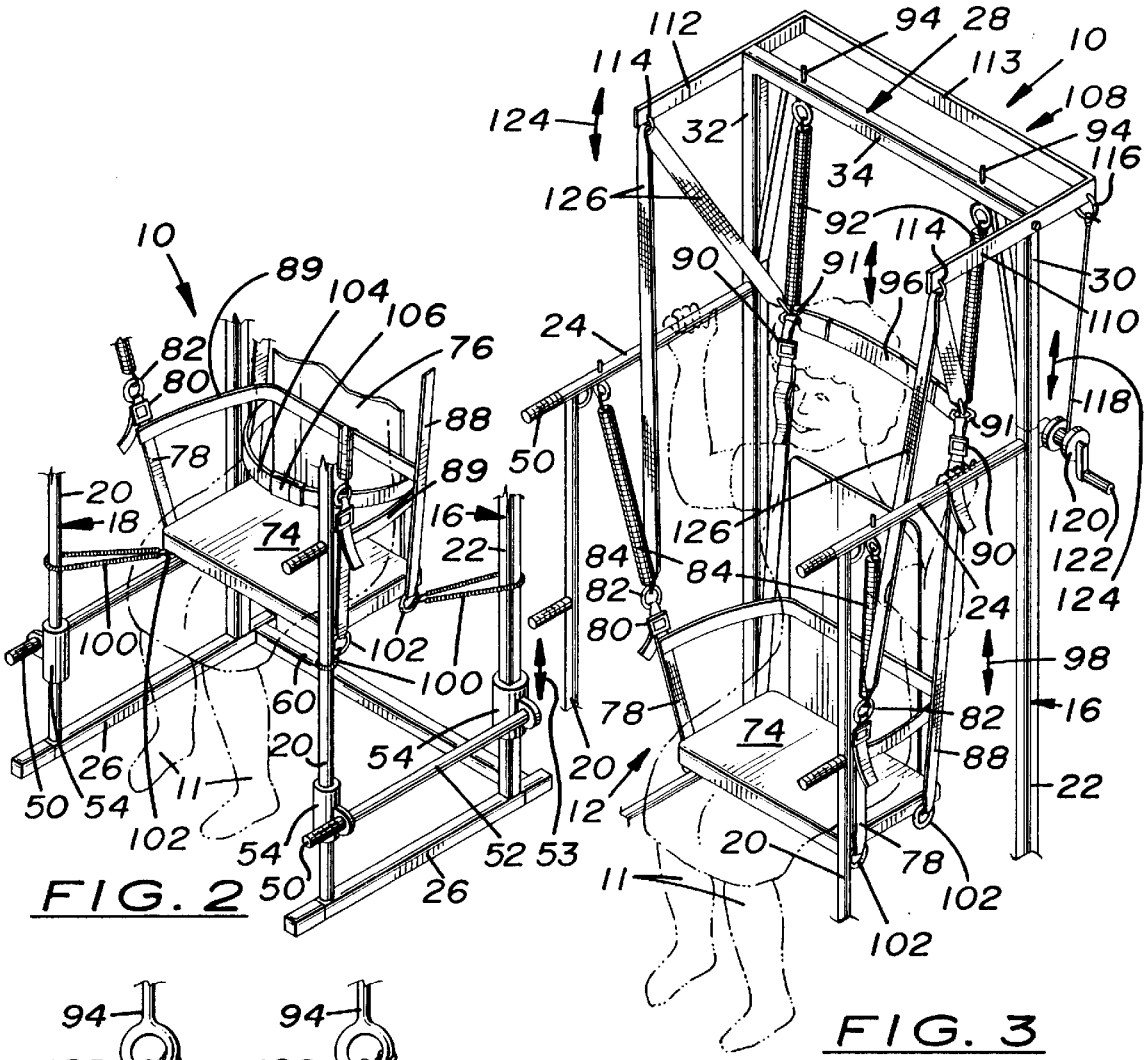
FIG. 2
FIG. 3
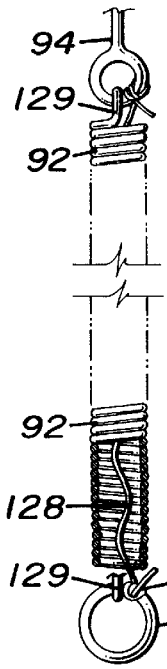
FIG. 4
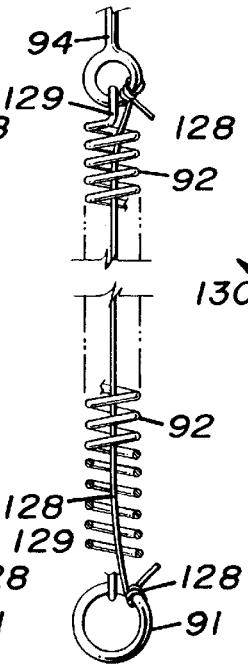
FIG. 5
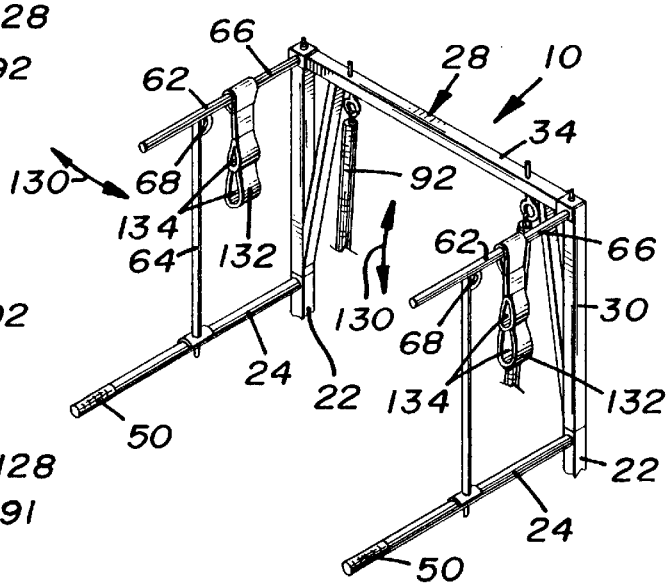
FIG. 6

AEROBIC BOUNCING, EXERCISING, STRETCHING CHAIR

BACKGROUND OF THE INVENTION (a) Field of the Invention

This invention relates to exercise devices and equipment and more particularly, but not by way of limitation, to an aerobic bouncing chair and chair frame exercise equipment.

(b) Discussion of Prior Art

Heretofore, there have been a variety of different types of aerobic and other types of exercise equipment. In U.S. Pat. No. 5,403,253 to Gaylord an exercise device and gymnastic training machine is disclosed. The machine includes a frame with a first and a second block and tackle pulley system suspended therefrom. A body harness is attached to the two pulley systems.

In U.S. Pat. Nos. 2,719,568 to Webb, 1,611,807 to Bergh, 3,778,052 to Andow et al., and French Patent 1,180,387 to Rupiani different types of invalid walkers and exercising devices with either seats or body harnesses are described.

In U.S. Pat. Nos. 3,730,587 to Bloxham et al., 5,201,693 to Sparkes and 767,774 to Stoyer different types of baby walkers and bouncers for exercising small children are disclosed.

None of the above mentioned patents disclose or teach the unique features and combination of structure making up the subject invention with the advantages and benefits to the user of the equipment as described herein.

SUMMARY OF THE INVENTION

In view of the foregoing, it is a primary object of the subject invention to provide cardio-vascular, lymphatic, muscle strengthening, stretching and isometric exercises for the user of the equipment. Also the bouncing chair helps the user of the equipment with increased blood circulation, coordination, balance and joint mobility.

Another object of the exercise equipment is to provide an exercise program that encompasses all ages from the very young to the very old. The equipment is particularly suited for the elderly, the handicapped, disabled and people confined to a wheelchair and others who heretofore obtained little or no exercise during their daily activities. Also, the equipment can be used for injury rehabilitation and sports medicine programs.

Still another object is the bouncing chair and chair frame exercise equipment is that it is easy and fun to use, is adjustable for people of different height and weight and allows the user to chose a variety of different types of exercises. The exercises include aerobics, isometrics, pull ups, push ups, chinning, muscle development, joint movements, stretching among others for better health and wellness.

The aerobic bouncing chair and chair frame exercise equipment includes a chair frame having a first side frame, a second side frame and a "C" shaped rear frame. The "C" shaped rear frame fits inside and is secured to the top of the first and second side frames for holding the entire chair frame in place. A seat with a back support and adjustable headrest includes four support straps with locking buckles and four suspension rings attached to the ends of the straps. The four suspension rings are attached to one end of four coil springs. An opposite end of the coil springs is attached to the chair frame. Two of the coil springs are secured to the rear frame and the other two coil springs are secured to the front of the first and second side frame. Each open end of the coil springs are secured to suspension rings and to first and second side frame eye bolts by using plastic sleeves. One end of the plastic sleeves is slid over an open end of each spring with the other end tucked inside the coils of the spring. The plastic sleeves prevent the spring coming loose from the rings and the eye bolts during the operation of the exercise equipment. The four support straps are adjustable for people of different heights and weights. Also the back support may include a safety belt to prevent the user of the chair from slipping off or bouncing off the seat. The seat also includes four seat rings attached to the underside of the seat at its corners. Each of the seat rings is used for receiving the hook ends of bungee cords or other securing types of material. The bungee cords are wrapped around a vertical portion of the front and back of the first and second side frames. The bungee cords steady the seat from moving when a user, for example a wheelchair person, is transferred from the wheelchair onto the seat with or without a slide transfer board and prior to the exercise program. The exercise equipment further includes many additional features such as front and rear base frame extension bars for added stability when the user swings backward and forward, when the person is exercising and/or swinging back and forth, movable bars for pull ups, chinning and arm exercises, fixed and/or adjustable height bars for isometric exercises along with a wheelchair transfer lift.

These and other objects of the present invention will become apparent to those familiar with various types of exercise equipment from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 2 is a perspective view of the lower half of the exercise equipment showing the bouncing chair secured in place using bungee cords and the chair with a seat belt for holding securely the user therein.

FIG. 3 is a perspective view of the upper half of the exercise equipment and illustrating a wheel chair lift apparatus attached to the top of the chair frame for transfering a person from a wheelchair onto the spring suspended seat.

FIG. 4 is a front view of one of the coil springs used for suspending the aerobic bouncing chair. The coil spring is shown in a relaxed position with a portion of the spring cut away to show a nylon safety cord threaded through the interior of the spring and attached at opposite ends to a ring and an eye bolt.

FIG. 5 is a front view of one of the coil springs used for suspending the aerobic bouncing chair. The coil spring is shown in an extended position in tension with a portion of the spring cut away to show the nylon safety cord preventing the over extension of the spring when used with the subject invention.

FIG. 6 illustrates a perspective view of a "L" shaped optional detachable upper exercise bar support where the horizontal support members are free to pivot on the rear frame for ease in assembly, disassembly, storage and shipping.

DESCRIPTION OF THE PREFERRED EMBODIMENTS

Figure 1:
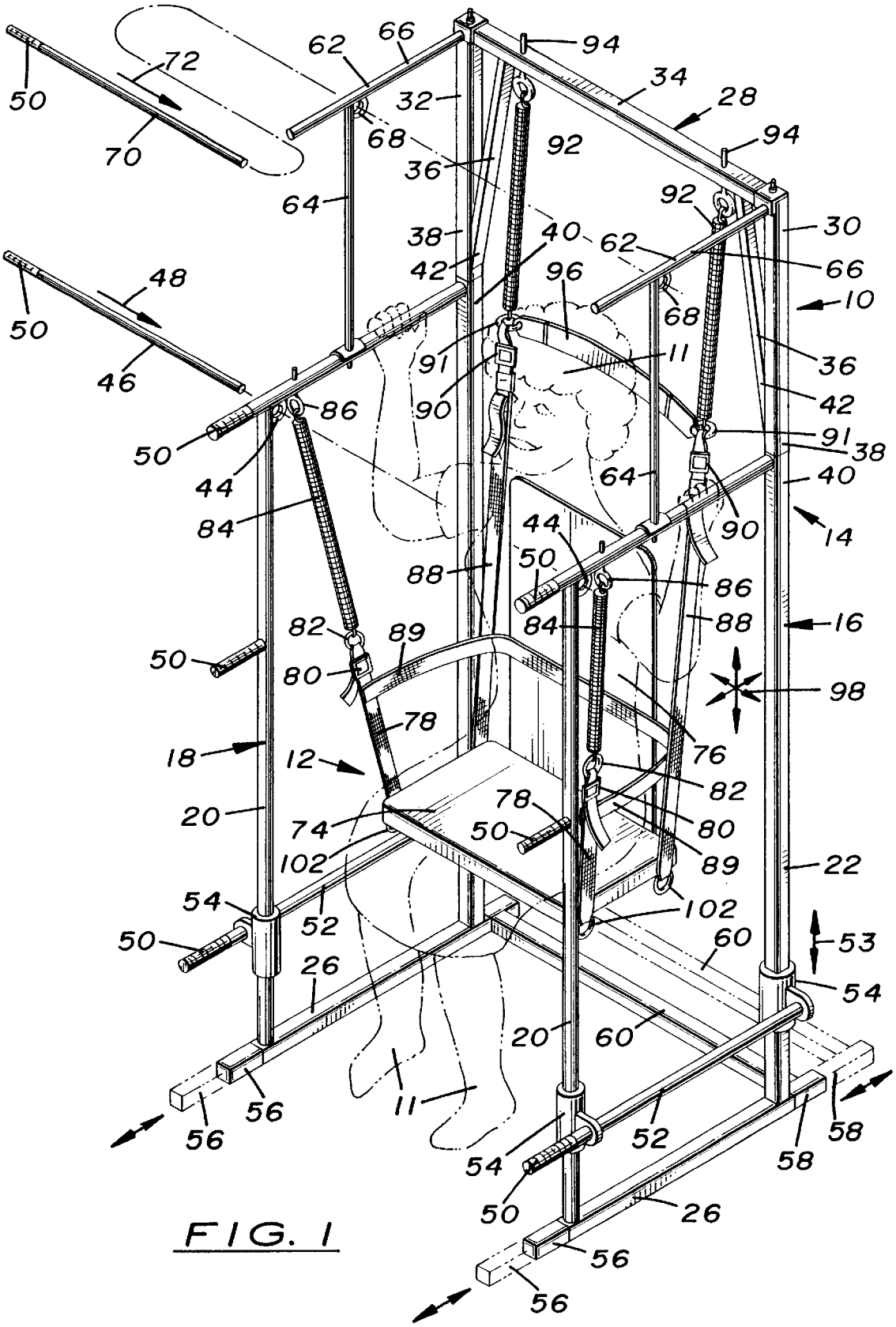
FIG. 1 is a perspective view of the subject aerobic bouncing chair and chair frame exercise equipment with a user of the equipment shown in dotted lines.

In FIG. 1, a perspective view of the subject aerobic bouncing chair and chair frame exercise equipment is shown having a general reference numeral 10. A user 11 of the equipment 10 shown in dotted lines. Broadly, an aerobic bouncing chair is shown having a general reference numeral 12 and a chair frame having a general reference numeral 14. The chair 12 and the chair frame 14 provide the key structural features of the invention.

Referring now to the chair frame 14, it includes a first side frame 16 and a second side frame 18. The side frames 16 and 18 includes a front vertical member 20, a rear vertical member 22, an upper horizontal member 24 and a lower horizontal base member 26. The chair frame 14 also includes a rear frame 28 having a first vertical member 30, a second vertical member 32, a horizontal spring support member 34 and a pair of angle braces 36 attached to the spring support member 34 and sides of the vertical members 30 and 32.

The rear frame 28 is used to secure the side frames 16 and 18 and the frames locked together using allen set screws or similar fasteners. During assembly, a lower portion 38 of the vertical members 30 and 32 is slidably received inside a top portion 40 of the rear vertical members 22 with a lower portion 42 of the angle braces 36 acting as a stop to assure proper insertion of the rear frame 28 into frames 16 and 18.

The first and second side frames 16 and 18 also include lower exercise bar rings 44 at the upper corner of the upper horizontal members 24 and the front vertical members 20. The rings 44 are used for slidably receiving a lower exercise bar 46 as indicated by arrow 48. The exercise bar 46 can be used for pull ups, chinning and other exercises. Also mounted on the front of the vertical members 20 are outwardly extending hand grips 50 which can be helpful to the elderly and handicapped for stability when approaching, entering, exiting and sitting in the bouncing chair 12. Also, the height adjustable grips 50 can be used for many various types of exercises and other conditioning while outside of the bouncing chair.

Further, the side frames 16 and 18 each include a fixed or removable sliding exercise bar 52 having adjustable height collars 54 mounted on the vertical front and rear members 20 and 22. The sliding exercise bar 52 may be raised or lowered, as indicated by arrow 53, on the front and rear vertical members 20 and 22 and tightened using fasteners such as allen screws or the like. The sliding exercise bar 52 can be used by the user 11 for pushing and pulling the bouncing chair 12 upward and downward and releasing the chair 12 during various types of exercise programs. Note, hand grips 50 are attached to the removable exercise bars and to the sliding exercise bars 52 which can be raised and lowered on the grips 50 to their best position for the user on the side frames 16 and 18.

Still further, the lower horizontal base members 26 of the sides frames 16 and 18 include front frame extension stabilizers 56 slidably received in a front end of the base members 26 and rear frame extension stabilizers 58 received in a rear end of the base members 26. The rear frame extension stabilizers 58 include a cross support 60 attached to the stabilizers 58 for added frame strength and stability. Obviously, by using the front and rear frame extension stabilizers 56 and 58 and shown in dotted lines in an extended position, the chair frame 14 has added and more rigidity and stability during the use of the exercise equipment 10. The front and rear extension stabilizers 56 and 58 are interchangable on the frames 16 and 18 and if desired two of the front stabilizers 56 or two of the rear stabilizers 58 may be used or any combination thereof.

Attached to the top of the upper horizontal members 24 of the first and second side frames 16 and 18 and opposite ends of the horizontal spring support member 34 of the rear frame 28 is a pair of "L" shaped horizontal upper bar support arms 62. The two support arms 62 include a vertical support member 64 with a lower end releasably attached to the upper horizontal members 24 and a horizontal support member 66 attached to the ends of the horizontal spring support member 34. At the corner of the intersection of the support members 64 and 66 is attached upper bar rings 68 for slidably receiving an upper exercise bar 70 as indicated by arrow 72. The upper exercise bar 46 and the support arms 66 can be used for pull ups, chinning and other arm strengthening exercises as well as body stretching exercises.

Referring now to the aerobic bouncing chair 12, it includes a padded seat 74 with back support 76. Extending upwardly from the front corners of the seat 74 are front adjustment straps 78 with buckles 80. The upper ends of the front adjustment straps 78 are attached to spring mounting rings 82 for releasable attachment to a lower end of a pair of side frame coil springs 84. An upper end of the coil springs 84 is attached to a pair of eye bolts 86 secured to the front of the upper horizontal members 24.

Extending upwardly from the rear corners of the seat 74 and attached to the sides of the back support 76 are rear adjustment straps 88 with buckles 90. The front and rear straps 78 and 88 are attached together by horizontal cross straps 89 for added strength and stability. The upper ends of the rear adjustment straps 88 are attached to spring mounting rings 91 for releasable attachment to a lower end of a pair of rear frame coil springs 92. An upper end of the coil springs 92 is attached to a pair of eye bolts 94 secured to the horizontal spring support member 34. By adjusting the front and rear adjustment straps 78 and 88 on the buckles 80 and 90, the seat 74 and back support 76 can be raised and lower for people of different heights and weights.

Also the chair 12 includes an adjustable head rest 96 with opposite ends attached to the rings 91. The head rest 96 includes buckles for adjusting the tension thereon. The head rest 96 is used by the user 11 for resting his or her head thereon during an exercise program. Also, the chair 12 can include a rigid head and neck brace and harness made of soft nylon strap material for holding the head and neck securely in place against the head rest 96 for added safety during the use of the exercise equipment 10. Some users, who may have very little or no control of their body or limbs may be strapped into the chair 12 by looping a strap with a locking buckle under their arm pits and through the rings 91. The length of the strap is adjusted to secure the user in the seat 74. The strap may also be criss crossed around the front of the users body and secured to the seat 74 by threading the strap through the rings 91 and the rear seat rings 102 with the tension on the strap adjusted to hold the user firmly in place for an exercise program. The head and neck brace are not shown in the drawings.

By gripping the upper horizontal bars 24 as shown or moving the body up and down, swinging front and back or side to side, as indicated by large arrow 98, the user 11 can begin an enjoyable, healthful aerobic and other types of exercises with the benefits as mentioned above. Also, the user 11 can grip and exercise with the lower removable front exercise bar 46, the upper front and removable exercise bar 70, the two side removable sliding exercise bar 52 and the many other vertical and horizontal parts of the chair frame 14 for additional exercises and activities.

In FIG. 2, is a perspective view of the lower half of the exercise equipment 10 is shown with the padded seat 74 secured in place using bungee cords 100. The cords are wrapped around a portion of the front and rear vertical members 20 and 22 with hook ends of the bungee cords 100 releasably attached to seat rings 102 attached to the four corners of the seat 74. The bungee cords 100 are used to minimize movement of the seat 74 when a user or more importantly, a physically challanged user is entering the seat 74 or a person in a wheelchair that is transfer onto the seat 74 with or without a slide board. The slide board is secured to the top of the seat by an adjustable length strap with a locking buckle. The strap is threaded through an open end of the slide board and seat rings 102 and tightly secured.

Also in this drawing, an adjustable length seat belt 104 with buckle 106 is shown attached to the back support 76 and used for holding the user 11 on the seat 74 closely and securely thereby prevent the person from bouncing off or slipping off the seat during any bouncing, swinging, stretching exercise programs and other activities.

In FIG. 3, a perspective view of the upper half of the exercise equipment 10 is shown illustrating a wheel chair lift having a general reference numeral 108. The lift 108 includes a "C" shaped frame made up of a first lift arm 110, a second lift arm 112 and a cross arm 113 connecting the arms 110 and 112 to minimize torqueing of the lift 108. The arms 110 and 112 are pivotally mounted on the top of the first and second vertical members 30 and 32 of the rear frame 28. The ends of the arms 110 and 112 include lifting rings 114. An opposite end of the arm 110 includes a cable ring 116 which is attached to one end of a hoist cable 118. The hoist cable 118 is received around a screw type hoist 120 having a handle 122 for manually raising and lowering the lift 108 as indicated by arrows 124. The hoist 120 may be located on either side of the frames 16 or 18.

A pair of chair lift straps 126 are attached to the lifting rings 114 with one end of the straps 126 releasably hooked to the spring mounting rings 91. The other end of the straps 126 is releasably hooked to the spring mounting rings 82. When the user 11 is ready to be transfered from his or her wheelchair, the lower end of springs 84 and 92 will have already been removed from the rings 82 and 91. The seat 74 and back support 76 will have also been positioned, by a prior transfer to the top of the users wheelchair seat, under and behind the user 11. With the straps 126 hooked to the rings 82 and 91, the hoist 120 is used to pivot the wheelchair lift 108 raising the arms 110 and 112 and in turn lifting the user 11 high enough so the springs 84 and 92 can be reattached to the rings 82 and 91 and the user 11 is lowered by the hoist 120 until the person is completely suspended by the coil springs 84 and 92 and the straps no longer support the user. The straps 126 are then removed from the rings 82 and 91 and the exercise program can be started. When the exercise program is completed, the straps 126 are again connected to the rings 82 and 91, the person is raised using the hoist 120 and the springs 84 and 92 are detached from the rings 82 and 91. The user 11, while in the seat 74, is then lowered onto his or her wheelchair seat and the seat 74 and with the back support 76. The user can then be transported to the area where he or she was orginally transferred from.

In FIG. 4 and FIG. 5, a front view of one of the coil springs 92 is shown with a portion of the spring cut away to illustrate the use of a heavy duty nylon cord 128 threaded through the interior of the spring 92 with opposite ends securely attached to ring 91 and eye bolt 94. The nylon cord has a tensile strength rating of 450 pounds and greater and provides a safety feature in the use of the bouncing chair 12. In FIG. 5, the spring 92 is shown stretched in tension with the cord 128 preventing the spring 92 from over extending loosing its elasticity and preventing the spring from breaking free. This feature protects a user of the exercise equipment from exceeding the limits of the coil springs 84 and 92 during an exercise program.

Also shown in FIGS. 4 and 5 are spring retaining sleeves 129, which are shown in dotted lines. One end of the sleeves 129 is received around the ends of the spring 92. The other end of the sleeves 129 is positioned back inside the center of the coil of the springs 92. In this manner, the sleeves prevent the springs 92 from coming loose from either the eye bolts 94 or the rings 91 when the springs 92 are used with the bouncing chair 12.

In FIG. 6, a perspective view of the "L" shaped detachable upper exercise bar support 62 is shown wherein the horizontal support member 66 is pivotally mounted on the horizontal spring support member 34. When the vertical support members 64 are released from the upper horizontal members 24, the "L" shaped upper bar exercise support 62 is free to pivot, as indicated by arrows, against the rear frame 28. This feature provides for easier assembly and disassembly, compactness in storage and ease in handling and shipping the exercise equipment 10.

Also shown in this drawing are limb and body stretching exercise straps 132 which are secured to a portion of the two horizontal support bars 66. The straps 132 have openings 134 therein for receiving the hands of the user 11 for doing arm strengthing exercises, pull ups, various neck, shoulder and back stretching exercises and the like. The straps 132 may be fixed in length or adjustable in length. The straps 132 may be removably attached to the exercise bars 46, 52 and 70, the horizontal bars of the rear frame 28 and the side frames 16 and 18.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An aerobic bouncing chair and chair frame exercise equipment for performing a variety of exercises, the equipment comprising:

a chair frame having a first side frame, a second side frame and a rear frame, said rear frame secured to said first and said second side frames for holding said chair frame in place; and a first coil spring, an upper end of said first coil spring attached to said first frame, a second coil spring, an upper end of said second coil spring attached to said second frame and a third coil spring, an upper end of said third coil spring attached to said rear frame, said first, second and third coil springs suspended from said frames; and a chair attached to a lower end of said first, second and third coil springs, said chair suspended on said coil springs, said chair bouncing on said chair frame during an aerobic exercise.

2. The equipment as described in claim 1 wherein said chair includes a padded seat with back support.

3. The equipment as described in claim 1 further including a lower exercise bar releasably attached to a top of said first and said second side frames.

4. The equipment as described in claim 1 further including a pair of "L" shaped upper bar supports attached to said rear frame and to a top of said first and said second side frames, said upper bar supports slidably receiving an upper exercise bar thereon.

5. The equipment as described in claim 1 further including front and rear extension stabilizers slidably attached to a bottom of said first and second side frames for providing added stability to said chair frame.

6. The equipment as described in claim 1 further including a pair of sliding exercise bars, each of said sliding exercise bars mounted on said first and second side frames, said sliding exercise bars adjustable horizontally up and down along a length of said first and second side frames.

7. The equipment as described in claim 1 further including a wheelchair lift with hoist attached to said chair frame and releasably attached to said chair.

8. The equipment as described in claim 1 further including a fourth coil spring, an upper end of said fourth coil spring attached to said rear frame, a lower end of said fourth coil spring attached to said chair.

9. An aerobic bouncing chair and chair frame exercise equipment for a user of the equipment to perform a variety of exercises thereon, the equipment comprising:

a chair frame having a first side frame, a second side frame and a rear frame, said rear frame secured to said first and said second side frames for holding said chair frame in place;

a seat with back support, said seat having straps attached to coil springs, said coil springs attached to said rear frame and to said first and second side frames, and seat adjustment means on said straps for raising and lower said seat on said chair frame.

10. The equipment as described in claim 9 wherein at one end of said straps are attached spring mounting rings, said coil springs releasably secured on said mounting rings.

11. The equipment as described in claim 10 wherein said coil springs include a high tension nylon cord threaded therein with one end of said cord attached to said mounting ring and preventing said coil springs from becoming free and over extending when said coil springs are under overload tension when bouncing the chair.

12. The equipment as described in claim 9 wherein said seat includes seat rings mounted on the corners of said seat, said seat rings used for attaching bungee cords and like cord material thereto when said bungee cords are wrapped around a portion of said first and second side frames, said bungee cords and said seat rings minimize movement of said seat when the user is entering said seat.

13. The equipment as described in claim 9 wherein said seat and back support include a safety belt to prevent the user of the chair from slipping off or bouncing off said seat.

14. An aerobic bouncing chair and chair frame exercise equipment for a user of the equipment to perform a variety of exercises thereon, the equipment comprising:

a chair frame having a first side frame, a second side frame and a rear frame, said rear frame secured to said first and said second side frames for holding said chair frame in place;

a seat with back support, said seat having straps attached to spring mounting rings, said rings attached to coil springs, said coil springs attached to said rear frame and to said first and second side frames, said seat having seat rings mounted on four corners of said seat, said seat rings used for holding said seat in place when the used gets in and out of said seat, and seat adjustment means on said straps for raising and lower said seat on said chair frame.

15. The equipment as described in claim 14 further including a pair of "L" shaped upper bar supports attached to said rear frame and to the top of said first and said second side frames, said upper bar supports slidably receiving an upper exercise bar thereon.

16. The equipment as described in claim 14 further including a wheelchair lift with hoist attached to said chair frame, said wheelchair lift having a pair of lift straps releasably attached to said spring mounting rings for lifting the user on said seat.

17. The equipment as described in claim 14 wherein said seat and back support include a safety belt to prevent the user of the chair from slipping off or bouncing off said seat.

18. The equipment as described in claim 14 further including front and rear extension stabilizers slidably attached to a bottom of said first and second side frames for providing added stability to said chair frame.

* * * * *

UNITED STATES PATENT AND TRADEMARK OFFICE

CERTIFICATE OF CORRECTION

PATENT NO. : 5,816,983

DATED : October 6,1998

INVENTOR(S) : Charles R. Dawes et al.

It is certified that error appears in the above-identified patent and that said Letters Patent is hereby corrected as shown below:

Title page, insert the following item:
[60] provisional appl. no: 60/014,597 filed 3/29/96

Column 1, line 3, insert the following:
-- Cross reference to related application: Reference is made to and priority claimed from U.S. provisional appl. Ser.No. 60/014,597 filed 3/29/66.

Signed and Sealed this

Sixteenth Day of May, 2000

*Attest:*

Q. TODD DICKINSON

*Attesting Officer*

*Director of Patents and Trademarks*